US006875134B2

(12) United States Patent
Sajima

(10) Patent No.: US 6,875,134 B2
(45) Date of Patent: Apr. 5, 2005

(54) GOLF BALL

(75) Inventor: Takahiro Sajima, Kobe (JP)

(73) Assignee: Sumitomo Rubber Industries, Ltd., Kobe (JP)

( * ) Notice: Subject to any disclaimer, the term of this patent is extended or adjusted under 35 U.S.C. 154(b) by 0 days.

(21) Appl. No.: 10/608,646

(22) Filed: Jun. 30, 2003

(65) Prior Publication Data

US 2004/0038754 A1 Feb. 26, 2004

(30) Foreign Application Priority Data

Aug. 20, 2002 (JP) ..... 2002-238763

(51) Int. Cl.[7] ..... A63B 37/14
(52) U.S. Cl. ..... 473/383
(58) Field of Search ..... 473/383, 384

(56) References Cited

U.S. PATENT DOCUMENTS 4,813,677 A * 3/1989 Oka et al. ..... 473/384
5,158,300 A 10/1992 Aoyama
5,857,924 A 1/1999 Miyagawa et al.
6,346,053 B1 2/2002 Inoue et al.
6,368,238 B1 4/2002 Kasashima et al.

FOREIGN PATENT DOCUMENTS

JP 5-237202 A 9/1993
JP 9-285566 A 11/1997
JP 11-89967 A 4/1999
JP 2000-279553 A 10/2000

* cited by examiner

*Primary Examiner*—Raeann Gorden
(74) *Attorney, Agent, or Firm*—Birch, Stewart, Kolasch & Birch, LLP

(57) ABSTRACT

A golf ball (1) comprises a large number of dimples (4) and a land portion (5) on a surface thereof. The dimple (4) is concaved from the surface of a phantom sphere shown in a two-dotted chain line. The dimple (4) includes an edge (E). The dimple (4) includes an outer region (6) on an outside of the edge (E). A mean value of a width (W) of the outer region (6) is 0.03 mm to 0.20 mm. A mean value of a ratio (W/d) of the width (W) of the outer region (6) to a maximum dimension (d) of the dimple (4) is 0.015 to 0.040. A mean value of an angle ($\alpha$) formed by the outer region (6) and a maximum dimension line (T) is 1.0 degree to 15.0 degrees. The separation of air flowing into the dimple (4) can be suppressed by the outer region (6).

17 Claims, 6 Drawing Sheets

GOLF BALL

BACKGROUND OF THE INVENTION

1. Field of the Invention

The present invention relates to a golf ball. More particularly, the present invention relates to an improvement in the sectional shape of a dimple.

2. Description of the Related Art

A golf ball has a large number of dimples on a surface thereof. The role of the dimples resides in one aspect that such dimples disturb an air stream around the golf ball during the flight ball to accelerate the transition of a turbulent flow at a boundary layer, thereby causing a turbulent flow separation (which will be hereinafter referred to as a "dimple effect"). The acceleration of the transition of the turbulent flow causes a separating point of air from the golf ball to be shifted backward so that a drag coefficient (Cd) is reduced, resulting in an increase in the flight distance of the golf ball. In addition, the acceleration of the transition of the turbulent flow increases a differential between upper and lower separating points of the golf ball which is caused by a back spin. Consequently, a lift acting on the golf ball is increased. An improvement in the sectional shape of the dimple intended for an enhancement in a flight performance has variously been proposed.

Japanese Laid-Open Patent Publication No. Hei 5-237202 (1993/237202) has disclosed a golf ball in which the edge angles of dimples having different sectional shapes from each other are equal. Japanese Laid-Open Patent Publication No. Hei 9-285566 (1997/285566) has disclosed a golf ball in which the inclination angle of a tangential line with respect to a surface in the edge of a dimple is set within a predetermined range. Japanese Laid-Open Patent Publication No. Hei 11-89967 (1999/89967) has disclosed a golf ball comprising a dimple having an edge angle of 30 degrees or less. Japanese Laid-Open Patent Publication No. 2000-279553 has disclosed a golf ball comprising a dimple having a special sectional shape. These techniques relate to the shape of a portion provided on the inside of an edge.

A golf player is most concerned about the flight distance of a golf ball. In respect of an enhancement in the flight distance, the sectional shape of a dimple has room for an improvement. It is an object of the present invention to improve the flight performance of a golf ball.

SUMMARY OF THE INVENTION

A golf ball according to the present invention comprises a large number of dimples on a surface thereof. The dimple includes an edge and an outer region positioned on an outside of the edge. A mean value of a width W of the outer region is 0.03 mm to 0.20 mm. The golf ball has the outer region having a great width W. The outer region contributes to an enhancement in the flight performance of the golf ball. The detailed reason why the outer region contributes to the enhancement in the flight performance is unclear. However, it can be guessed that the flight performance can be enhanced because the separation of air flowing toward the inside of the dimple is suppressed by the outer region.

It is preferable that a mean value of a ratio (W/d) of the width W of the outer region to a maximum dimension d of the dimple should be 0.015 to 0.040. It is preferable that a mean value of an angle a formed by the outer region and a maximum dimension line should be 1.0 degree to 15.0 degrees.

DESCRIPTION OF THE PREFERRED EMBODIMENTS

A preferred embodiment of the present invention will be described below in detail with reference to the drawings.

Figure 1:
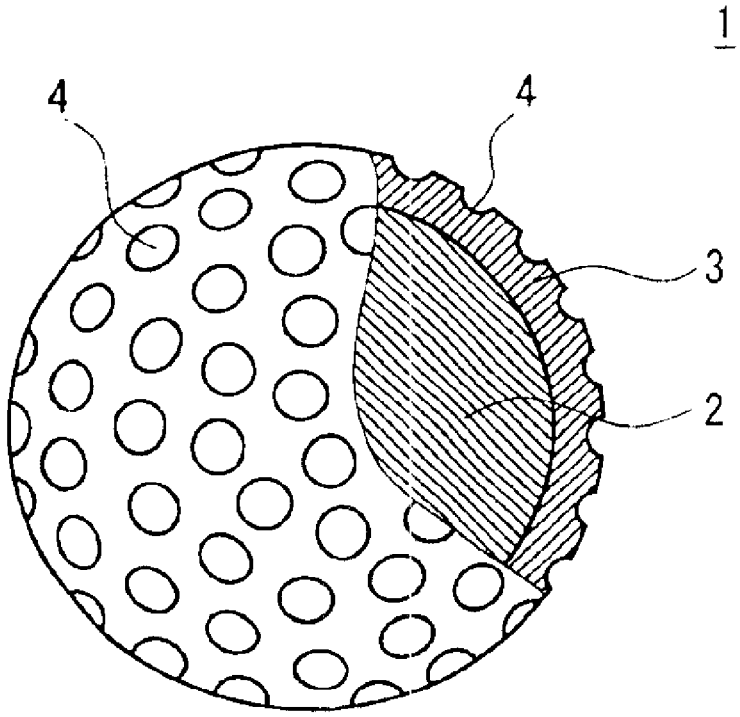
FIG. 1 is a sectional view showing a golf ball according to an embodiment of the present invention, a part of which is taken away.

A golf ball 1 shown in FIG. 1 comprises a spherical core 2 and a cover 3. A large number of dimples 4 are formed on the surface of the cover 3. The golf ball 1 has a paint layer and a mark layer on the outside of the cover 3, which are not shown.

The golf ball 1 usually has a diameter of 40 mm to 45 mm, and furthermore, 42 mm to 44 mm. In consideration of a reduction in an air resistance within such a range that the standards of the United States Golf Association (USGA) are satisfied, it is particularly preferable that the diameter should be 42.67 mm to 42.80 mm. The golf ball 1 usually has a weight of 40 g to 50 g, and furthermore, 44 g to 47 g. In consideration of an enhancement in an inertia within such a range that the standards of the USGA are satisfied, it is preferable that the weight should be 45.00 g to 45.93 g.

The core 2 is formed by crosslinking a rubber composition. Examples of the base rubber of the rubber composition include polybutadiene, polyisoprene, a styrene-butadiene copolymer, an ethylene-propylene-diene copolymer and a natural rubber. Two kinds of rubbers may be used together. In respect of a resilience performance, the polybutadiene is preferable and high cis-polybutadiene is particularly preferable.

A co-crosslinking agent is usually used for crosslinking the core 2. In respect of the resilience performance, examples of a preferable co-crosslinking agent include zinc acrylate, magnesium acrylate, zinc methacrylate and magnesium methacrylate. It is preferable that an organic peroxide, together with the co-crosslinking agent, should be blended with the rubber composition. Examples of a suitable organic peroxide include dicumyl peroxide, 1,1-bis(t-butyl peroxy)-3,3,5-trimethyl cyclohexane, 2,5-dimethyl-2,5-di(t-butyl peroxy) hexane and di-t-butyl peroxide.

Various additives such as a filler, sulfur, an antioxidant, a coloring agent, a plasticizer and a dispersing agent are blended in a proper amount with the rubber composition if necessary. Crosslinked rubber powder or synthetic resin powder may be blended with the core 2.

The core 2 usually has a diameter of 30.0 mm to 42.0 mm, and particularly 38.0 mm to 41.5 mm. The core 2 may be constituted by two layers or more.

The cover 3 is formed by a synthetic resin composition. Examples of the base resin of the cover 3 include an ionomer resin, a thermoplastic polyurethane elastomer, a thermoplastic polyamide elastomer, a thermoplastic polyester elastomer, and a thermoplastic polyolefin elastomer.

A coloring agent, a filler, a dispersing agent, an antioxidant, an ultraviolet absorbent, a light stabilizer, a fluorescent agent or a fluorescent brightening agent is blended in a proper amount with the cover 3 if necessary. In order to regulate a specific gravity, powder of a metal having a high specific gravity such as tungsten or molybdenum may be blended with the cover 3.

The cover 3 usually has a thickness of 0.3 mm to 6.0 mm, and particularly 0.6 mm to 2.4 mm. The cover 3 may be constituted by two layers or more.

Figure 2:
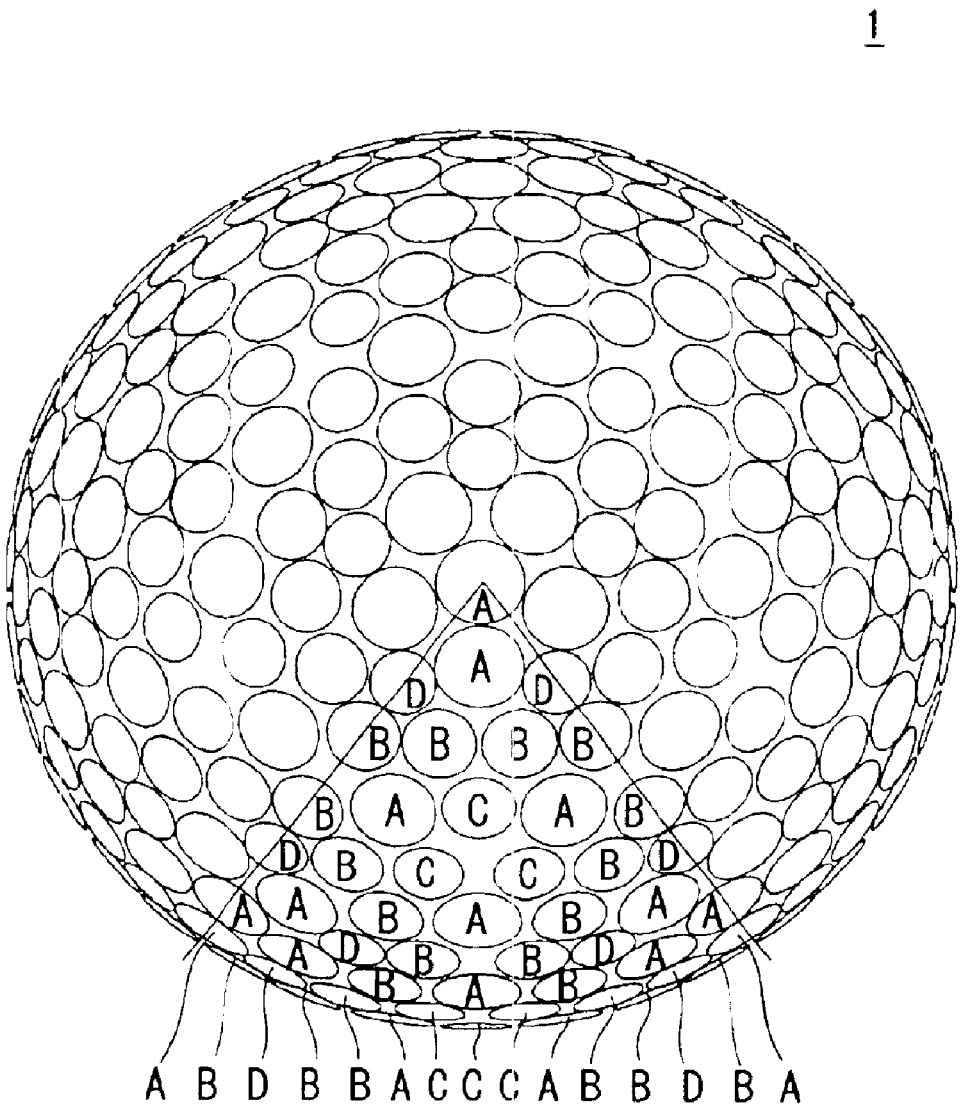
FIG. 2 is an enlarged plan view showing the golf ball of FIG. 1.
Figure 3:
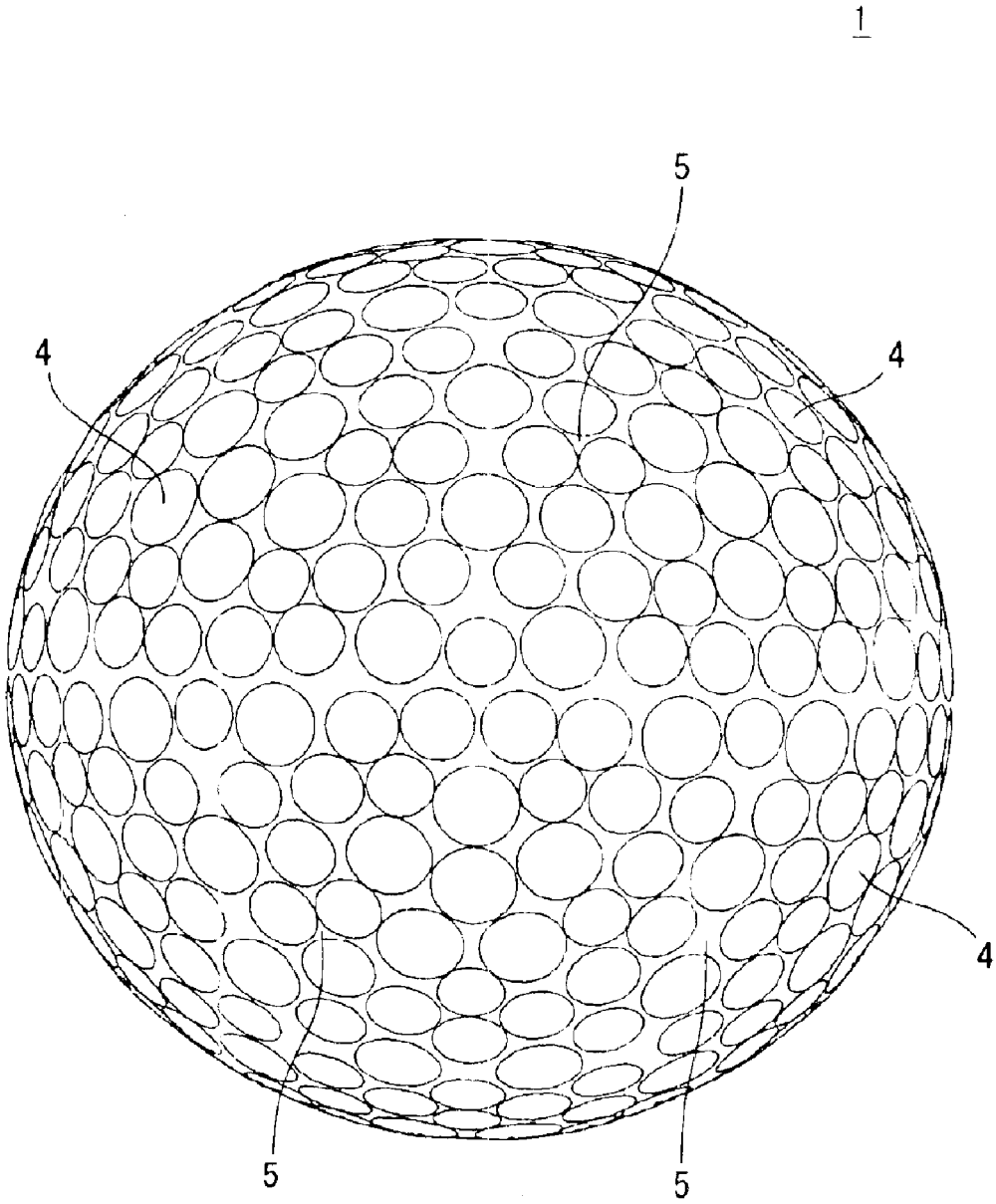
FIG. 3 is an enlarged front view showing the golf ball of FIG. 1.

FIG. 2 is an enlarged plan view showing the golf ball 1 in FIG. 1 and FIG. 3 is a front view showing the golf ball 1. As is apparent from FIGS. 2 and 3, all dimples 4 have circular plane shapes. In FIG. 2, the types of the dimple 4 are indicated as A to D in one of ten equivalent units obtained by comparting the surface of the golf ball 1. The golf ball 1 has an A dimple having a diameter of 4.05 mm, a B dimple having a diameter of 3.60 mm, a C dimple having a diameter of 3.40 mm and a D dimple having a diameter of 3.2 mm. The number of the A dimples is 132, that of the B dimples is 180, that of the C dimples is 60 and that of the D dimples is 60. The total number of the dimples of the golf ball 1 is 432.

Figure 4:
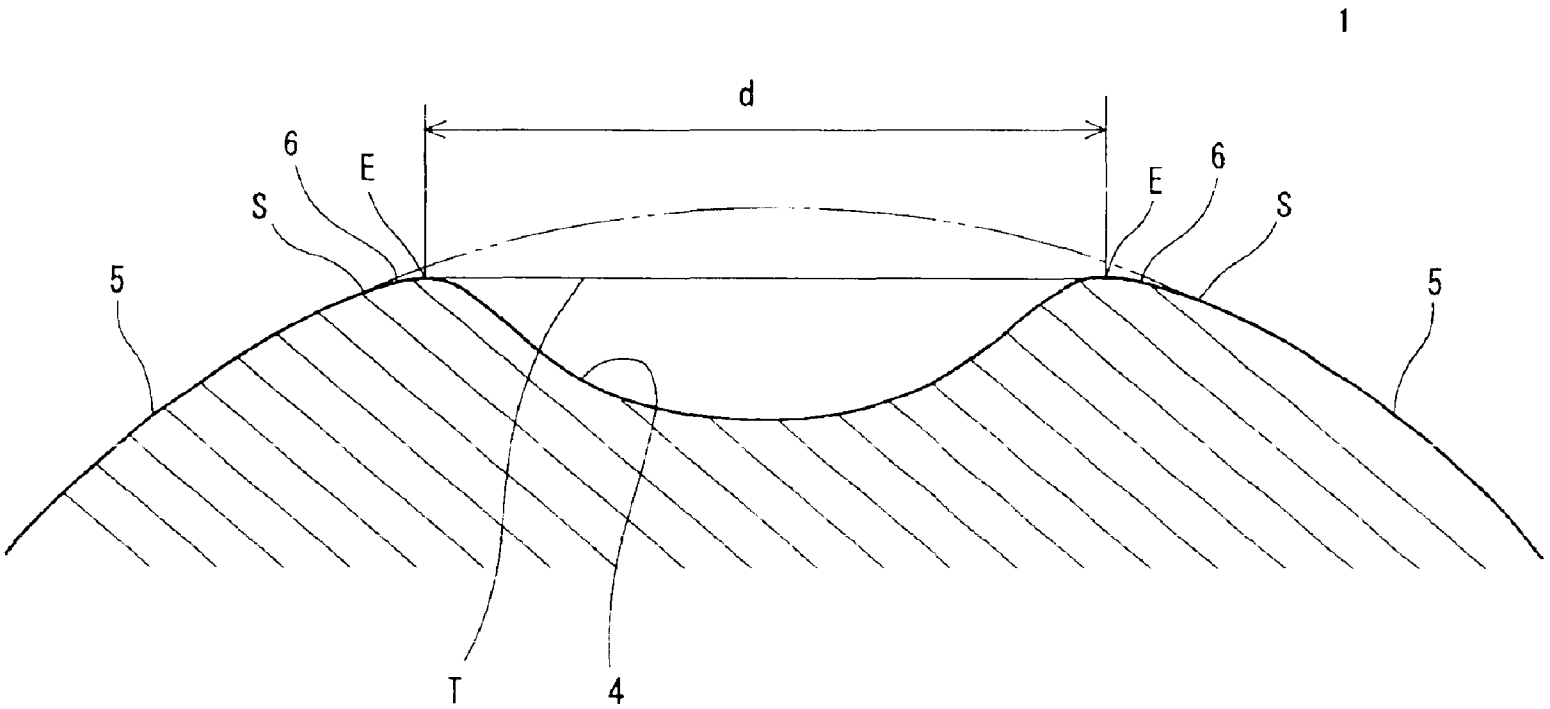
FIG. 4 is a typical enlarged sectional view showing a part of the golf ball in FIG. 1.

FIG. 4 is a typical enlarged sectional view showing a part of the golf ball 1 in FIG. 1. FIG. 4 illustrates a section passing through the deepest portion of the dimple 4 and the center of a phantom sphere. The surface of the golf ball 1 is constituted by the dimple 4 and a land portion 5. The land portion 5 is provided in places other than the dimple 4. The phantom sphere is shown in a two-dotted chain line of FIG. 4. In the phantom sphere, it is assumed that the dimple 4 is not present. The dimple 4 is concaved from the phantom sphere. The land portion 5 is coincident with the phantom sphere. In FIG. 4 the designation S denotes a boundary between the dimple 4 and the land portion 5. In other words, the surface of the golf ball 1 is separated from the phantom sphere on the inside of the boundary S and is coincident with the phantom sphere on the outside of the boundary S.

In FIG. 4, an arrow d denotes a diameter of the dimple 4. The diameter d indicates a distance between one of contact points E and the other contact point E which are obtained by drawing a common tangential line T on both sides of the dimple 4. The contact point E also acts as an edge of the dimple 4. The edge E defines the plane shape of the dimple 4. In this specification, the length of the longest segment which can be drawn in the plane shape of the dimple 4 is referred to as a maximum dimension. In a circular dimple, the diameter d is the maximum dimension. In this specification, the tangential line T is also referred to as a maximum dimension line.

Figure 5:
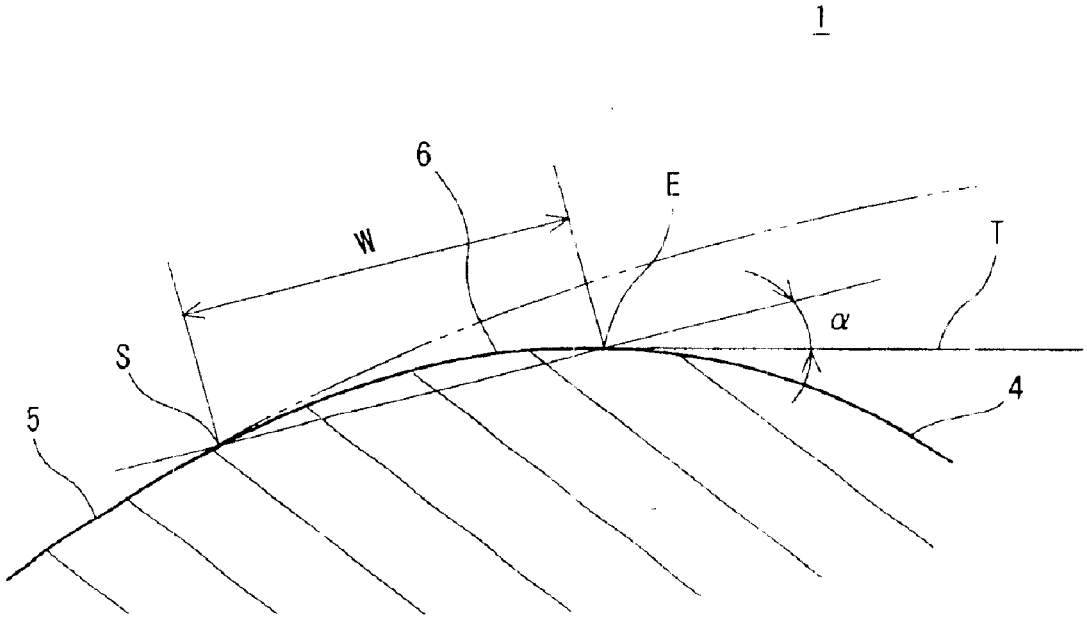
FIG. 5 is a typical sectional view in which a part of the golf ball of FIG. 4 is further enlarged.

FIG. 5 is a typical sectional view in which a part of the golf ball 1 in FIG. 4 is further enlarged. A region interposed between the boundary S and the edge E in the surface of the golf ball 1 indicates an outer region 6. The outer region 6 is lower than the phantom sphere. The outer region 6 forms a part of the dimple 4. In FIG. 5, air flowing from left to right passes through a region on the left side of the boundary S and then passes through the outer region 6, and flows into a region on the right side of the edge E. The region on the right side of the edge E is lower than the phantom sphere. In this region, therefore, the air is apt to separate from the surface of the dimple 4. Since the outer region 6 which is lower than the phantom sphere is present on the upstream of the edge E, the air drops stepwise. Consequently, the separation of the air in the region on the right side of the edge E is suppressed so that the air smoothly flows into the dimple 4. The outer region 6 enhances a dimple effect. The flight performance of the golf ball 1 is enhanced by the outer region 6.

A straight distance W between the boundary S and the edge E is the width of the outer region 6. It is preferable that the mean value of the width W of the outer region 6 should be 0.03 mm to 0.20 mm. If the mean value of the width W is less than the range, the separation of the air is suppressed with difficulty. In this respect, the mean value of the width W is more preferably 0.05 mm or more, and particularly preferably 0.07 mm or more. In some cases in which the mean value of the width W is more than the same range, a surface area occupation ratio which will be described below is reduced so that the flight performance of the golf ball 1 becomes insufficient. From this viewpoint, the mean value of the width W is more preferably 0.18 mm or less, and particularly preferably 0.15 mm or less.

In the golf ball 1 shown in FIGS. 1 to 5, the widths W of the outer regions 6 of all the dimples 4 are 0.12 mm. Accordingly, the mean value of the widths W is 0.12 mm.

The width W is measured in a portion which is adjacent to the land portion 5. In other words, the width W is always measured in a portion in which the dimple 4 is adjacent to another dimple 4 through the land portion 5. One of the dimples 4 usually has a plurality of portions which are adjacent to the land portion 5. In one of these portions which is determined at random, the width W of the dimple 4 is measured. In principle, the total of the widths W of all the dimples 4 is divided by the total number of the dimples so that a mean value is calculated. In the dimple in which an adjacent portion to the land portion 5 is not present, the width W cannot be measured. In the dimple 4 other than the dimple in which the adjacent portion to the land portion 5 is not present, the width W is measured and the mean value is thus calculated.

In the golf ball 1 having the cover 3 formed by an injection molding method, a dimple formed by the tip of a holding pin and the tip of a bent pin is present. In the dimple formed by the tip of the pin, it is hard to accurately measure the width W. In such a golf ball 1, the width W is measured in the dimples 4 other than the dimples formed by the tip of the pin. Thus, a mean value is calculated.

The number of the dimples which are not considered in the calculation of the mean value of the widths W, for example, the dimple in which the adjacent portion to the land portion 5 is not present, the dimple formed by the tip of the pin and the like is preferably 10% of the total number of the dimples or less, and particularly preferably 5% or less.

It is preferable that the width W of each of the dimples 4 should be 0.02 mm to 0.22 mm. If the width W is less than the range, the separation of the air is suppressed with difficulty. From this viewpoint, the width W is more preferably 0.04 mm or more, and particularly preferably 0.06 mm or more. In some cases in which the width W is more than the same range, a surface area occupation ratio which will be described below is reduced so that the flight performance of the golf ball 1 becomes insufficient. From this viewpoint, the width W is more preferably 0.20 mm or less, and particularly preferably 0.18 mm or less. A ratio of the number of the dimples 4 having the width W within the range to the total number of the dimples is preferably 50% or more, more preferably 65% or more, and particularly preferably 80% or more.

It is preferable that the width W should be comparatively increased in the dimple 4 having a great maximum dimension d and the width W should be comparatively decreased in the dimple 4 having a small maximum dimension d. It is preferable that the mean value of the ratio (W/d) of the width W of the outer region 6 to the maximum dimension d of the dimple 4 should be 0.015 to 0.040. If the mean value of (W/d) is less than the range, the separation of the air is suppressed with difficulty. From this viewpoint, the mean value of (W/d) is more preferably 0.018 or more, and particularly preferably 0.020 or more. In some cases in which the mean value of (W/d) is more than the same range, a transition of a turbulent flow is inhibited. In this respect, the mean value of (W/d) is more preferably 0.037 or less, and particularly preferably 0.035 or less. In principle, the total of (W/d) for all the dimples 4 is divided by the total number of the dimples so that a mean value is calculated. The dimple in which the width W cannot be measured is not considered in the calculation of the mean value of (W/d).

In the golf ball 1 shown in FIGS. 1 to 5, the A dimple has (W/d) of 0.0296, the B dimple has (W/d) of 0.0333, the C dimple has (W/d) of 0.0353 and the D dimple has (W/d) of 0.0375. The mean value of (W/d) of the golf ball 1 is 0.033.

It is preferable that the ratio (W/d) in each of the dimples 4 should be 0.010 to 0.045. If (W/d) is less than the range, the separation of the air is suppressed with difficulty. From this viewpoint, (W/d) is more preferably 0.013 or more, and particularly preferably 0.015 or more. In some cases in which (W/d) is more than the same range, a transition of a turbulent flow is inhibited. In this respect, the mean value of (W/d) is more preferably 0.042 or less, and particularly preferably 0.040 or less. A ratio of the number of the dimples 4 having (W/d) within the range to the total number of the dimples is preferably 50% or more, more preferably 65% or more, and particularly preferably 80% or more.

It is preferable that the mean value of an angle $\alpha$ formed by the outer region 6 and the maximum dimension line T should be 1.0 degree to 15.0 degrees. If the mean value of $\alpha$ is less than the range, the separation of the air is suppressed with difficulty. From this viewpoint, the mean value of $\alpha$ is more preferably 3.0 degrees or more, and particularly preferably 5.0 degrees or more. In some cases in which the mean value of $\alpha$ is more than the same range, the edge E blocks the flow of the air so that the dimple effect is reduced. In this respect, the mean value of $\alpha$ is more preferably 12.0 degrees or less, and particularly preferably 10.0 degrees or less. In principle, the total of $\alpha$ for all the dimples 4 is divided by the total number of the dimples so that the mean value is calculated. The dimple in which the width W cannot be measured is not considered in the calculation of the mean value of $\alpha$.

In the golf ball 1 shown in FIGS. 1 to 5, all the dimples 4 have $\alpha$ of 7.0 degrees. Accordingly, the mean value of $\alpha$ is 7.0 degrees. As shown in FIG. 5, an angle formed by a straight line passing through the boundary S and the edge E and the tangential line T passing through the edge E is indicated as $\alpha$.

It is preferable that $\alpha$ in each of the dimples 4 should be 0.5 degree to 17.5 degrees. If $\alpha$ is less than the range, the separation of the air is suppressed with difficulty. From this viewpoint, $\alpha$ is more preferably 2.5 degrees or more, and particularly preferably 4.5 degrees or more. In some cases in which $\alpha$ is more than the same range, the edge E blocks the flow of the air so that the dimple effect is reduced. In this respect, $\alpha$ is more preferably 14.5 degrees or less, and particularly preferably 12.5 degrees or less. It is preferable that a ratio of the number of the dimples 4 having $\alpha$ within the range to the total number of the dimples should be 50% or more, more preferably 65% or more, and particularly preferably 80% or more.

Figure 6:
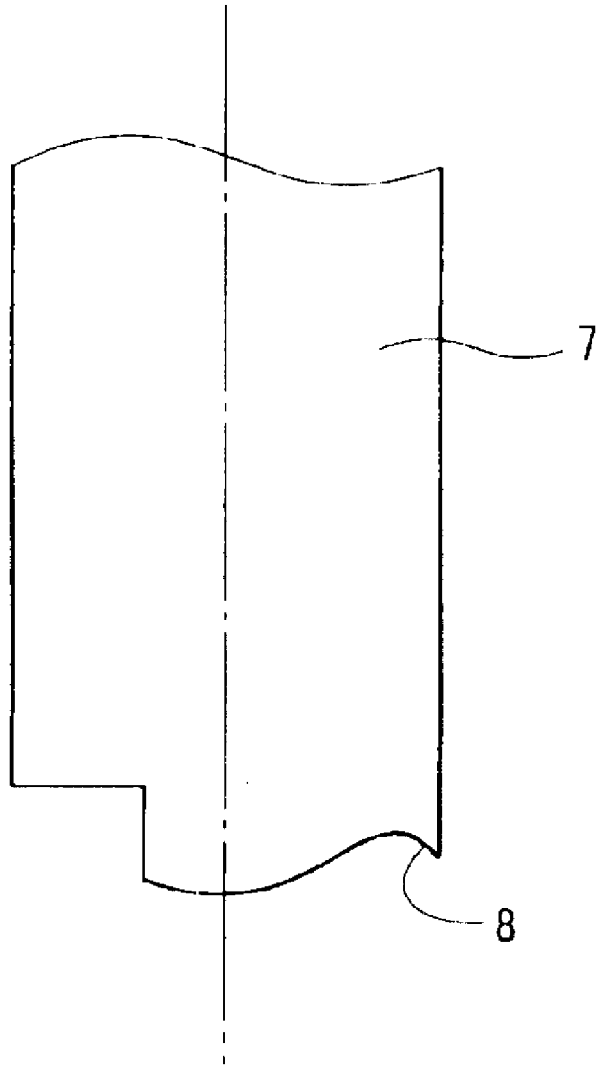
FIG. 6 is a front view showing a part of a cutting tool for forming a dimple in FIG. 4.

FIG. 6 is a front view showing a part of a cutting tool 7 for forming the dimple 4 in FIG. 4. The cutting tool 7 comprises a protruded portion 8. By means of the cutting tool 7, a concave portion is formed in a master mold. By the master mold, a mold is formed. A convex portion having a shape obtained by inverting the shape of the concave portion of the master mold is formed in the mold. By means of the mold, the golf ball 1 is formed. The dimple 4 having a shape obtained by inverting the shape of the convex portion of the mold is formed on the golf ball 1. The dimple 4 includes the outer region 6. The outer region 6 has a shape obtained by inverting the shape of the protruded portion 8.

In some cases, the master mold is not fabricated but a cylindrical metal block is directly cut by means of a tool so that the mold is manufactured. In these cases, the vicinity of the edge of the convex portion is rounded by means of the tool. By this mold, similarly, the golf ball 1 comprising the outer region 6 is formed.

A bowl-shaped dimple may be formed and an edge thereof may be rounded by polishing to form the outer region 6. The bowl-shaped dimple may be formed and the vicinity of the edge of the dimple may be painted in a nonuniform thickness to form the outer region 6.

In FIG. 5, the volume of a portion surrounded by the phantom sphere and the surface of the dimple 4 indicates a dimple volume. It is preferable that the total volume of the dimples 4 should be 300 $mm^3$ to 700 $mm^3$. In some cases in which the total volume is less than the range, a trajectory is too high. In this respect, it is particularly preferable that the total volume should be 350 $mm^3$ or more. If the total volume is more than the same range, there is a possibility that the trajectory might be too low. In this respect, the total volume is particularly preferably 600 $mm^3$ or less.

In the golf ball 1 shown in FIGS. 1 to 5, the A dimple has a volume of 1.555 $mm^3$, the B dimple has a volume of 1.087 $mm^3$, the C dimple has a volume of 0.938 $mm^3$, and the D dimple has a volume of 0.772 $mm^3$. The golf ball 1 has a total volume of 503.5 $mm^3$.

A ratio of the total area of the dimples 4 to the surface area of the phantom sphere is referred to as a surface area occupation ratio. It is preferable that the surface area occupation ratio should be 70% to 90%. If the surface area occupation ratio is less than the range, the lift of the golf ball 1 might become insufficient during a flight. In this respect, the surface area occupation ratio is more preferably 72% or more, and particularly preferably 75% or more. If the surface area occupation ratio is more than the same range, a trajectory might be too high. In this respect, the surface area occupation ratio is more preferably 88% or less, and particularly preferably 86% or less.

The area of the dimple 4 represents the area of a region surrounded by an edge line (that is, the area of a plane shape) when the center of the golf ball 1 is seen at infinity. In the case of the dimple 4 having a circular plane shape, an area s is calculated by the following equation.

$$s=(d/2)^2\cdot\pi$$

In the golf ball 1 shown in FIGS. 1 to 5, the A dimple has an area of 12.9 $mm^2$, the B dimple has an area of 10.2 $mm^2$, the C dimple has an area of 9.1 $mm^2$, and the D dimple has an area of 8.0 $mm^2$. The golf ball 1 has a total area of 4564.8 $mm^2$. The total area is divided by the surface area of the phantom sphere so that a surface area occupation ratio is calculated. In the golf ball 1, the surface area occupation ratio is 79.6%.

It is preferable that the mean value of the maximum dimension d of the dimple 4 should be 3.0 mm to 5.0 mm.

In some cases in which the mean value of the maximum dimension d is less than the range, the dimple effect becomes insufficient. In this respect, the mean value of the maximum dimension d is more preferably 3.2 mm or more, and particularly preferably 3.4 mm or more. In some cases in which the mean value of the maximum dimension d is more than the same range, the surface of the golf ball 1 is deformed. In this respect, the mean value of the maximum dimension d is more preferably 4.8 mm or less, and particularly preferably 4.6 mm or less.

It is preferable that the maximum dimension d of each of the dimples 4 should be 2.2 mm to 6.0 mm. In some cases in which the maximum dimension d is less than the range, the dimple effect becomes insufficient. In this respect, the maximum dimension d is more preferably 2.5 mm or more, and particularly preferably 2.7 mm or more. In some cases in which the maximum dimension d is more than the same range, the surface of the golf ball 1 is deformed. In this respect, the maximum dimension d is more preferably 5.8 mm or less, and particularly preferably 5.6 mm or less. A ratio of the number of the dimples 4 having the maximum dimension d within the range to the total number of the dimples is preferably 50% or more, more preferably 65% or more, and particularly preferably 80% or more.

It is preferable that the depth of each of the dimples 4 should be 0.1 mm to 0.6 mm. In some cases in which the depth is less than the range, a trajectory is too high. In this respect, the depth is more preferably 0.12 mm or more, and particularly preferably 0.14 mm or more. In some cases in which the depth is more than the range, the trajectory is too low. In this respect, the depth is more preferably 0.55 mm or less, and particularly preferably 0.50 mm or less. A ratio of the number of the dimples 4 having the depths within the range to the total number of the dimples is preferably 50% or more, more preferably 65% or more, and particularly preferably 80% or more. The depth indicates a distance from the surface of the phantom sphere to the deepest portion of the dimple 4.

It is preferable that the total number of the dimples 4 should be 200 to 500. If the total number is less than the range, the dimple effect is obtained with difficulty. In this respect, the total number is more preferably 230 or more, and particularly preferably 260 or more. If the total number is more than the same range, the dimple effect is obtained with difficulty. In this respect, the total number is more preferably 470 or less, and particularly preferably 440 or less.

Two or more kinds of dimples 4 may be formed. A non-circular dimple may be formed in place of the circular dimple 4 or together with the circular dimple 4. In the case of the non-circular dimple, a section passing through the deepest portion and the center of the phantom sphere and having a maximum dimension is selected. In the section, a width W, an angle α and a maximum dimension d are measured.

While the golf ball 1 shown in FIG. 1 has a two-pieces structure, it is preferable that the dimple 4 including the outer region 6 should also be formed in a multipiece golf ball, a wound golf ball or a one-piece golf ball.

EXAMPLES

Example 1

A core formed of a solid rubber and having a diameter of 38.4 mm was put in a mold and an ionomer resin composition was injected around the core to form a cover. The surface of the cover was coated so that a golf ball according to an example 1 which has a dimple pattern shown in a plan view of FIG. 2 and a front view of FIG. 3 was obtained. The golf ball had an outside diameter of approximately 42.70 mm and a weight of 45.4 g. A compression of the golf ball which was measured by an ATTI compression tester produced by Atti Engineering Co., Ltd. is approximately 85. The golf ball includes 132 A dimples having a diameter of 4.05 mm, a depth of 0.2667 mm and a volume of 1.555 $mm^3$, 180 B dimples having a diameter of 3.60 mm, a depth of 0.2337 mm and a volume of 1.087 $mm^3$, 60 C dimples having a diameter of 3.40 mm, a depth of 0.2348 mm and a volume of 0.938 $mm^3$, and 60 D dimples having a diameter of 3.20 mm, a depth of 0.2220 mm and a volume of 0.772 $mm^3$. The golf ball has a total dimple volume of 503.5 $mm^3$ and a surface area occupation ratio of 79.6%. A width W, a ratio (W/d) and an angle α of an outer region are shown in the following Table 1.

Examples 2 to 5 and Comparative Examples 1 to 3

A golf ball according to each of examples 2 to 5 and comparative examples 1 to 3 was obtained in the same manner as that in the example 1 except that a width W, a ratio (W/d) and an angle α of an outer region were set as shown in the following Tables 1 and 2.

[Flight Distance Test]

A driver comprising a metal head ("XXIO W#1" produced by Sumitomo Rubber Industries, Ltd., loft: 8 degrees, shaft hardness: X) was attached to a swing machine (produced by True Temper Co.). A golf ball was hit on the condition that a head speed is 49 m/sec, a launch angle is approximately 11 degrees, and a back spin speed is approximately 3000 rpm. Then, a carry (a distance between a launch point and a drop point), a run (a distance between the drop point and a stationary point) and a total distance (a distance between the launch point and the stationary point) were measured. It was almost windless at time of the measurement. The following Tables 1 and 2 show the mean value of the results of the measurement for 20 golf balls.

TABLE 1

| | | Specification of Dimple | | | |
|---|---|---|---|---|---|
| | | Example 1 | Example 2 | Example 3 | Example 4 |
| Width W (mm) | A dimple | 0.12 | 0.12 | 0.12 | 0.08 |
| | B dimple | 0.12 | 0.12 | 0.12 | 0.03 |
| | C dimple | 0.12 | 0.12 | 0.12 | 0.08 |
| | D dimple | 0.12 | 0.12 | 0.12 | 0.03 |
| | Mean | 0.12 | 0.12 | 0.12 | 0.05 |
| Ratio W/D | A dimple | 0.0296 | 0.0296 | 0.0296 | 0.0198 |
| | B dimple | 0.0333 | 0.0333 | 0.0333 | 0.0083 |
| | C dimple | 0.0353 | 0.0353 | 0.0353 | 0.0235 |
| | D dimple | 0.0375 | 0.0375 | 0.0375 | 0.0094 |
| | Mean | 0.033 | 0.033 | 0.033 | 0.014 |
| Angle α (degree) | A dimple | 7.0 | 0.5 | 16.0 | 7.0 |
| | B dimple | 7.0 | 0.5 | 16.0 | 7.0 |
| | C dimple | 7.0 | 0.5 | 16.0 | 7.0 |
| | D dimple | 7.0 | 0.5 | 16.0 | 7.0 |
| | Mean | 7.0 | 0.5 | 16.0 | 7.0 |
| Flite distance (m) | Carry | 220.2 | 219.4 | 219.2 | 217.8 |
| | Run | 18.1 | 17.2 | 17.8 | 16.4 |
| | Total | 238.3 | 236.6 | 237.0 | 234.2 |

TABLE 2

| | | Specification of Dimple | | | |
|---|---|---|---|---|---|
| | | Example 5 | Com. Example 1 | Com. Example 2 | Com. Example 3 |
| Width W (mm) | A dimple | 0.19 | 0.02 | 0.21 | 0.00 |
| | B dimple | 0.19 | 0.02 | 0.21 | 0.00 |
| | C dimple | 0.19 | 0.02 | 0.21 | 0.00 |
| | D dimple | 0.19 | 0.02 | 0.21 | 0.00 |
| | Mean | 0.19 | 0.02 | 0.21 | 0.00 |
| Ratio W/D | A dimple | 0.0496 | 0.0049 | 0.0519 | 0.0000 |
| | B dimple | 0.0528 | 0.0056 | 0.0583 | 0.0000 |
| | C dimple | 0.0559 | 0.0059 | 0.0618 | 0.0000 |
| | D dimple | 0.0594 | 0.0063 | 0.0656 | 0.0000 |
| | Mean | 0.052 | 0.006 | 0.058 | 0.000 |
| Angle α (degree) | A dimple | 7.0 | 7.0 | 7.0 | — |
| | B dimple | 7.0 | 7.0 | 7.0 | — |
| | C dimple | 7.0 | 7.0 | 7.0 | — |
| | D dimple | 7.0 | 7.0 | 7.0 | — |
| | Mean | 7.0 | 7.0 | 7.0 | — |
| Flite distance (m) | Carry | 218.4 | 216.2 | 217.0 | 215.8 |
| | Run | 16.8 | 15.7 | 16.0 | 15.4 |
| | Total | 235.2 | 231.9 | 233.0 | 231.2 |

As shown in the Tables 1 and 2, the golf balls according to the examples have greater flight distances than those of the golf balls according to the comparative examples. From the results of evaluation, the advantage of the present invention is apparent.

The above description is only illustrative and can be variously changed without departing from the scope of the present invention.

What is claimed is:

1. A golf ball comprising a cover and a core, wherein the cover has a large number of dimples on a surface thereof, and wherein the dimples include dimples having an edge, a boundary defining the outer perimeter of the outer region, and an outer region positioned on an outside of the edge wherein the boundary is defined by the intersection of a surface of a phantom sphere and a land portion of the over from which the phantom sphere surface extends; wherein the edge is defined by a common tangential line extending across an outer periphery of the dimple; wherein the outer region is defined between the boundary and the edge so as to be below the phantom sphere surface;

and wherein a mean value of a width W of the outer region is 0.03 mm to 0.20 mm.

2. The golf ball according to claim 1, wherein a mean value of a ratio (W/d) of the width W of the outer region to a maximum dimension d of the dimple is 0.01 to 0.040, wherein the maximum dimension d is the longest segment that can be drawn within a plane defined by the edge, and wherein the width W is defined by a line extending from the edge to the boundary.

3. The golf ball according to claim 1, wherein a mean value of an angle a formed by α line extending from the edge to the boundary within the outer region and a maximum dimension line T is 1.0 degree to 15.0 degrees, wherein the maximum dimension line T is the longest tangential segment that can be drawn between two points within the edge of the dimple.

4. The golf ball according to claim 2, wherein a mean value of an angle α formed by a line extending from the edge to the boundary within the outer region and a maximum dimension line T is 1.0 degree to 15.0 degrees, wherein the maximum dimension line T is the longest tangential segment that can be drawn between two points within the edge of the dimple.

5. The golf ball according to claim 1, wherein the mean value of the width W of the outer region is 0.05 to 0.18 mm.

6. The golf ball according to claim 1, wherein the mean value of the width W of the outer region is 0.07 mm to 0.15 mm.

7. The golf ball according to claim 1, wherein the proportion of dimples on the golf ball which have the defined outer region width mean value is 90% or greater.

8. The golf ball according to claim 2, wherein the mean value of a ratio (W/d) of the width W of the outer region to a maximum dimension d of the dimple is 0.018 to 0.037.

9. The golf ball according to claim 2, wherein the mean value of a ratio CW/d) of the width W of the outer region to a maximum dimension d of the dimple is 0.020 to 0.035.

10. The golf ball according to claim 2, wherein the proportion of the number of dimples having the mean value ratio (W/d) is 50% or more.

11. The golf ball according to claim 2, wherein the proportion of the number of dimples having the mean value ratio (W/d) is 65% or more.

12. The golf ball according to claim 2, wherein the proportion of the number of dimples having the mean value ratio (W/d) is 80% or more.

13. The golf ball according to claim 3, wherein the mean value of the angle α formed by the outer region an a maximum dimension line T is 3.0 degrees to 12.0 degrees.

14. The golf ball according to claim 3, wherein the mean value of the angle α formed by the outer region an a maximum dimension line T is 5.0 degrees to 10.0 degrees.

15. The golf ball according to claim 3, wherein the proportion of the number of dimples having the angle α is 50% or more.

16. The golf ball according to claim 3, wherein the proportion of the number of dimples having the angle α is 65% or more.

17. The golf ball according to claim 3, wherein the proportion of the number of dimples having the angle α is 80% or more.

* * * * *